US005741993A

United States Patent [19]

Kushimiya

[11] Patent Number: 5,741,993

[45] Date of Patent: Apr. 21, 1998

[54] ELECTRONIC KEYBOARD HAVING A DISCRETE PITCH BENDER

[75] Inventor: Kiyomichi Kushimiya, Shizuoka-ken, Japan

[73] Assignee: Kabushiki Kaisha Kawai Gakki Seisakusho, Japan

[21] Appl. No.: 682,267

[22] Filed: Jul. 17, 1996

[30] Foreign Application Priority Data

Aug. 1, 1995 [JP] Japan ..... 7-213941

[51] Int. Cl.[6] ..... G10H 7/00

[52] U.S. Cl. ..... 84/645; 84/628; 84/704; 84/746

[58] Field of Search ..... 84/628, 645, 704, 84/746, DIG. 25

[56] References Cited

U.S. PATENT DOCUMENTS

| | | | |
|---|---|---|---|
| 4,653,374 | 3/1987 | Iba | 84/628 X |
| 4,813,327 | 3/1989 | Abe . | |
| 5,099,738 | 3/1992 | Hotz | 84/645 X |
| 5,119,713 | 6/1992 | Usa et al. . | |
| 5,149,904 | 9/1992 | Kamiya et al. . | |
| 5,286,911 | 2/1994 | Murata et al. . | |
| 5,350,883 | 9/1994 | Kitamura et al. | 84/746 X |

*Primary Examiner*—William Shoop, Jr.
*Assistant Examiner*—Jeffrey W. Donels
*Attorney, Agent, or Firm*—Andrus, Sceales, Starke & Sawall

[57] ABSTRACT

Provided is an electronic keyboard, which has a sequentially variable operating terminal, that comprises: a detector for detecting an operational displacement of the sequentially variable operating terminal, a linear converter for converting into a linear value the operational displacement of the sequentially variable operating terminal that is detected by the detector, a linear conversion table that is to be referred to when the linear converter converts the operational displacement into the linear value, a bender MIDI converter for converting into a bender MIDI value the linear value that is obtained by the linear converter, and a bender MIDI conversion table that is to be referred to when the bender MIDI converter converts the linear value into the bender MIDI value; and wherein the bender MIDI converter refers to the bender MIDI conversion table to convert the operational displacement of the sequentially variable operating terminal into a discrete bender MIDI value.

9 Claims, 8 Drawing Sheets

| A<br>LINEAR VALUE | B<br>BENDER MIDI VALUE |
|---|---|
| 00 | 00 00 |
| 01 | 00 00 |
| 02 | 00 00 |
| 03 | 00 00 |
| 04 | 00 00 |
| 05 | 00 00 |
| 06 | 00 00 |
| 07 | 05 00 |
| 08 | 05 00 |
| 09 | 05 00 |
| 0A | 05 00 |
| 0B | 05 00 |
| 0C | 05 00 |
| 0D | 05 00 |
| 0E | 05 00 |
| 0F | 05 00 |
| 10 | 05 00 |
| 11 | 05 00 |
| . | . |
| 7F | 40 00 |
| 80 | 40 00 |
| 81 | 40 00 |
| 82 | 40 00 |
| . | . |
| . | . |
| . | . |
| . | . |
| . | . |
| FC | 7F 7F |
| FD | 7F 7F |
| FE | 7F 7F |
| FF | 7F 7F |

FIG. 3

| A<br>LINEAR VALUE | B<br>BENDER MIDI VALUE |
|---|---|
| 00 | 00 00 |
| 01 | 00 40 |
| 02 | 01 00 |
| 03 | 01 40 |
| 04 | 02 00 |
| 05 | 02 40 |
| 06 | 03 00 |
| 07 | 03 40 |
| 08 | 04 00 |
| 09 | 04 40 |
| 0A | 05 00 |
| 0B | 05 40 |
| 0C | 06 00 |
| 0D | 06 40 |
| 0E | 07 00 |
| 0F | 07 40 |
| 10 | 08 00 |
| 11 | 08 40 |
| . | . |
| 7F | 3F 40 |
| 80 | 40 00 |
| 81 | 40 40 |
| 82 | 41 00 |
| . | . |
| . | . |
| . | . |
| . | . |
| . | . |
| FC | 7E 40 |
| FD | 7E 7F |
| FE | 7F 40 |
| FF | 7F 7F |

FIG. 8

ELECTRONIC KEYBOARD HAVING A DISCRETE PITCH BENDER

BACKGROUND OF THE INVENTION

1. Field of the Invention

The present invention relates to an electronic keyboard, such as a synthesizer or a mother board, with which can be obtained effects that, for example, simulate a slide, which is produced while a string of a guitar is bent and is touching the frets, and a legato passage, such as is produced by a saxophone, during which musical tones that are being generated are changed in half-tone segments.

2. Related Arts

For the production with current electronic keyboards of diverse musical tones, pitchbenders, keyboard pressure, modulation wheels, and expression pedals are employed to simulate a variety of effects, such as choking with guitars, vibrato with violins and crescendo with brass wind instruments.

The conventional electronic keyboards, however, can not well simulate a slide, which is produced while a string of a guitar is bent and is touching frets, and a legato passage, such as is produced by a saxophone, during which musical tones that are being produced are changed in half-tone segments.

This is because the maximum value that is provided by a pitch change when using a pitchbender, i.e., the displacement provided by a sequentially variable operating terminal when its setting is Max, is equivalent to a half tone, for example. This displacement is detected and is changed into a sequential smooth pitch.

FIG. 8 is a diagram illustrating one example relationship, for the conventional electronic keyboard, between a linear value, which is determined in consonance with the manipulation displacement of the sequentially variable operating terminal, and a bender MIDI output value, which is determined in consonance with the linear value.

With the electronic keyboard, the manipulation displacement of the sequentially variable operating terminal is detected by using resistance against sliding, for example. Based on the detected voltage, a linear conversion table is then referred to and the manipulation displacement is converted into a digital linear value, as is shown in FIG. 8A.

Based on the obtained linear value, a CPU then refers to a bender MIDI conversion table and converts the linear value into a bender MIDI value, as shown in the example in FIG. 8B.

The bender MIDI conversion table that is used for the conventional electronic keyboard is so set that as the linear value is increased, the bender MIDI output value is also sequentially increased in a one-to-one correspondence, as is shown in FIG. 8.

As a result, although the conventional electronic keyboard can simulate sequential musical tones, such as those produced by choking with the guitar, it can not simulate a discrete pitch change, such as a legato passage, in which, by the manipulation of the buttons of a saxophone, notes are discretely changed during the expiration of a single breath.

The electronic keyboard has a function whereby with the depression of keys musical tones are generated for every chromatic scale. When a PCM tone generator is used, for each key depression a tone (head), which is mixed, for example, with a higher overtone at a rising portion at the start of the flexing the strings of a guitar or of the blowing a trumpet, is produced and is changed to a normal clear sound.

Therefore, while a normal clear tone is being produced, tones for chromatic scales can not be changed by the depression of keys.

SUMMARY OF THE INVENTION

It is therefore one object of the present invention to provide an electronic keyboard that converts changes in displacement, which occur as the result of the manipulation of a sequentially variable operating terminal, to discrete pitch changes in units of half a tone, so that only a simple operation is required to simulate slides and legato passages.

According to the present invention, provided is an electronic keyboard, which has a sequentially variable operating terminal, that comprises: detection means for detecting an operational displacement of the sequentially variable operating terminal, linear conversion means for converting into a linear value the operational displacement of the sequentially variable operating terminal that is detected by the detection means, a linear conversion table that is to be referred to when the linear conversion means converts the operational displacement into the linear value, bender MIDI conversion means for converting into a bender MIDI value the linear value that is obtained by the linear conversion means, and a bender MIDI conversion table that is to be referred to when the bender MIDI conversion means converts the linear value into the bender MIDI value; and wherein the bender MIDI conversion means refers to the bender MIDI conversion table to convert the operational displacement of the sequentially variable operating terminal into a discrete bender MIDI value.

The sequentially variable operating terminal according to the present invention is a pitchbender.

Further, the sequentially variable operating terminal according to the present invention is an expression pedal.

According to the present invention, a displacement that is produced by the manipulation of the sequentially variable operating terminal is converted into a discrete bender MIDI value, which is then added to a MIDI output value that is generated by the depression of a key, so that a slide and a legato passage can be provided.

The linear conversion means converts into a linear value the operational displacement of the sequentially variable operating terminal, which is detected by the detection means, by referring to the linear conversion table.

Then, the bender MIDI conversion means converts the linear value into a discrete bender MIDI value by referring to a discrete table, i.e., the bender MIDI conversion table, that is provided for slides and legato passages.

The obtained bender MIDI value is transmitted via a MIDI output section to a MIDI device, and is added to a MIDI output value by the MIDI device to produce a musical tone.

Since the bender MIDI value that is detected during the MIDI output is added to the MIDI output value, the present invention can produce slides and legato passages. Further, with a simple structure in which the bender MIDI conversion table is provided, the present invention can simulate slides and legato passages.

BRIEF DESCRIPTION OF THE DRAWINGS

FIG. 3 is a diagram for explaining the structure of a bender MIDI conversion table;

FIG. 8 is a diagram for explaining the structure of a conventional bender MIDI conversion table.

DETAILED DESCRIPTION OF THE PREFERRED EMBODIMENT

The present invention relates to an electronic keyboard that can simulate a slide, which is produced by bending a string of a guitar so that it contacts the frets, and a legato passage, such as is produced by a saxophone, during which musical tones that are being generated are changed in units of half a tone, for example.

The preferred embodiment of the present invention will now be described while referring to the accompanying drawings. The present invention, however, is not limited to the embodiment. In this preferred embodiment of the present invention, a pitchbender is employed as a sequentially variable operating terminal.

Figure 1:
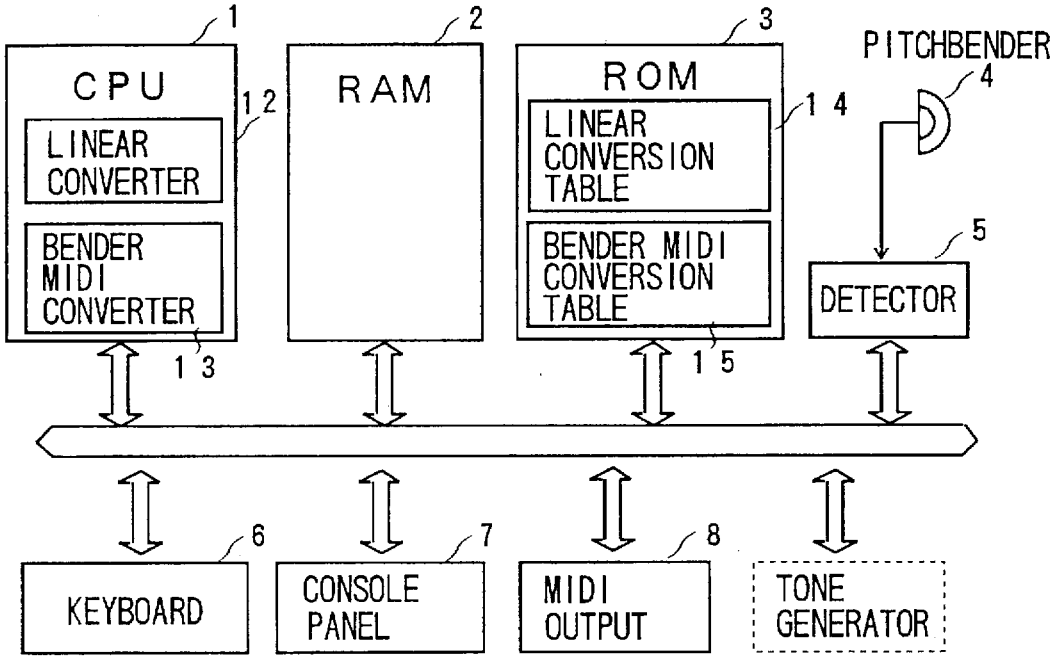
FIG. 1 is a schematic block diagram illustrating the general structure of an electronic keyboard according to the present invention.

FIG. 1 is schematic block diagram illustrating the general structure of an electronic keyboard according to the present invention.

A CPU 1 controls the individual sections of the electronic keyboard in accordance with a control program that is stored in a program memory area of a ROM 3.

A linear converter 12 refers to a linear conversion table 14 and converts a voltage, which is an analog value indicating the rotational displacement of a pitchbender, into a digital linear value shown in FIG. 3A.

A bender MIDI converter 13 refers to a bender MIDI conversion table 15 to convert the obtained linear value into a bender MIDI value shown in FIG. 3B.

In a RAM 2 are defined a work area for the CPU 1, and various tables, registers and flags for controlling the electronic keyboard. Also, an area for storing the status information of the device is provided in the RAM 2.

The ROM 3 is used to store a program that controls the entire electronic keyboard. In addition to the control program, various fixed data that the CPU 1 employs are stored in the ROM 3. The ROM 3 is accessed by the CPU 1 via a system bus.

The linear conversion table 14 that is referred to for the conversion of a detected value into a linear value, and the bender MIDI conversion table 15 that is referred to for the conversion of the linear value into a bender MIDI value are provided in the ROM 3.

A pitchbender 4, a sequentially variable operating terminal, is controlled by a player to instruct the changing of notes during a slide or a legato passage. The rotational displacement of the pitchbender 4 is detected as a voltage via a variable resistor, for example, and the voltage is transmitted to the linear converter 12 where it is converted into a linear value.

A detector 5 detects the rotational displacement of the pitchbender 4 as a voltage value by employing, for example, a sliding resistance, and transmits the detected voltage value to the CPU 1.

A keyboard 6 consists of a plurality of keys and key switches that are opened and closed in consonance with the depression and release of the keys. The key depression/release at the keyboard 6 is detected by a key scan circuit (not shown). It should be noted that, by rotating the pitchbender 4, a half tone note change is added to a tone, the production of which is instructed by the depression of a key at the keyboard 6.

On a console panel 7 are provided a power switch and various other switches. The pitchbender 4 that is related to the present invention is located at a position on the console panel 7 where it can be easily manipulated.

A MIDI output section 8 transmits information concerning a key-ON event (play data) as MIDI data to a MIDI device via a MIDI interface circuit. Thus, the MIDI device performs tone generation or recording.

Although in this embodiment, as is described above, a pitchbender 4 has been employed as the sequentially variable operating terminal, a wheel, a slider, a volume control, or an expression pedal may be used as a sequentially variable operating terminal.

Figure 2:
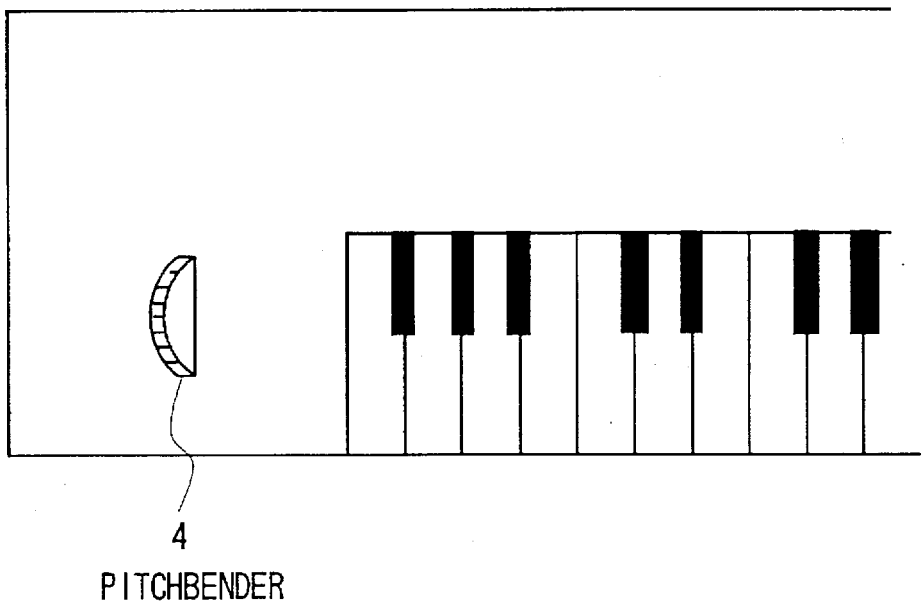
FIG. 2 is a diagram illustrating one part of the electronic keyboard of the present invention.

FIG. 2 is a diagram illustrating a part of the electronic keyboard according to the present invention where the pitchbender 4 is provided on the console panel 7.

The pitchbender 4 is a spring-loaded pitchbend wheel. When the pitchbender 4 is moved either up or down while a key is depressed, the tone of the note that is being produced is raised or lowered in consonance with the displacement of the pitchbender 4.

FIG. 3 is a diagram for explaining the structure of the bender MIDI conversion table 15, of the present invention, that is referred to by the bender MIDI converter 13 when it converts a linear value into a bender MIDI value.

In FIG. 3A are shown digital linear values obtained by the linear converter 12 when it has converted the voltage that was detected by the detector 5 in consonance with the displacement of the pitchbender 4. In FIG. 3B are shown example bender MIDI values into which the linear values are converted.

As is explained while referring to FIG. 8, when the conventional electronic keyboard converts a linear value into a bender MIDI value, as the linear value is increased, the obtained bender MIDI value is likewise sequentially increased.

In this embodiment, however, as is shown in FIG. 3, the bender MIDI value is set to 0000 within the linear value range of 00 to 06, and the bender MIDI value is set to 0500 within the linear value range of 07 to 11.

As a result, the bender MIDI value that is output by the bender MIDI converter 13 is discrete, and changes that correspond to a chromatic scale are permitted. Further, while a tone is being generated in response to the depression of a key, the note can be changed by using the pitchbender 4. Thus, the head that includes a higher overtone is not produced each time a note is changed, and slides and legato passages can be provided.

Figure 4:
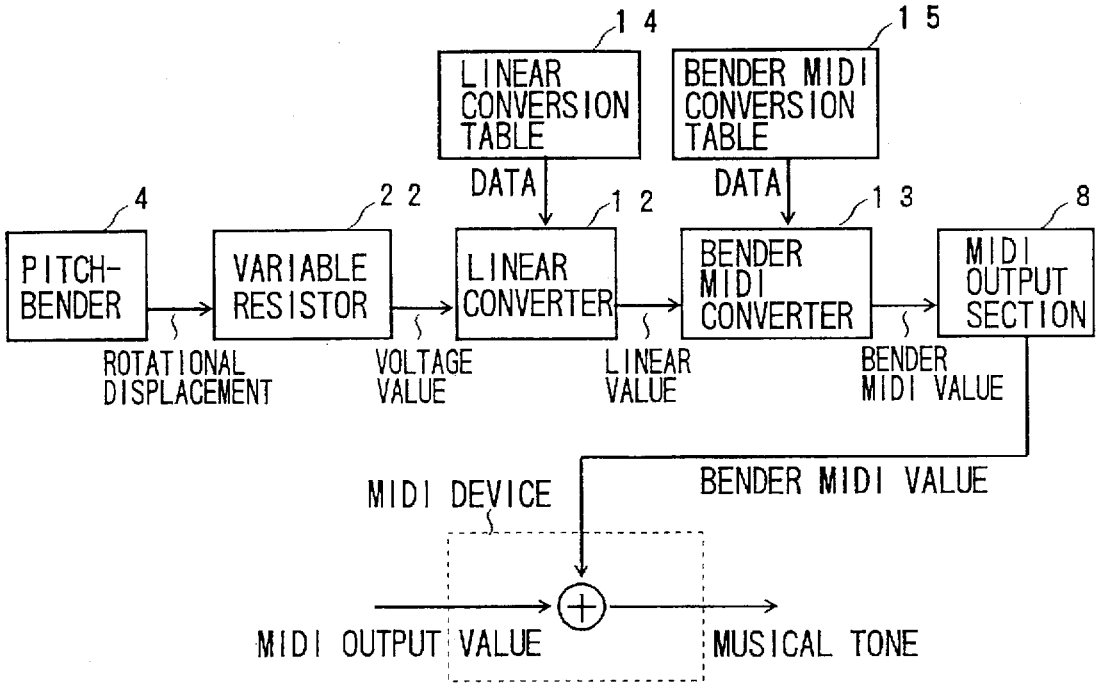
FIG. 4 is a block diagram for explaining the functions of the electronic keyboard of the present invention.

The process, for generating a bender MIDI value, that accompanies the detection of the displacement of the pitchbender 4 will now be described while referring to FIG. 4.

When the pitchbender 4 is manipulated during a performance, a voltage value, which is detected by, for example, a variable resistor 22, that indicates the degree of displacement of the pitchbender 4 is transmitted to the CPU 1. Based on the received voltage value, the linear converter 12 in the CPU 1 refers to the linear conversion table 14 to convert the displacement of the pitchbender 4 into a linear value, and transmits the linear value to the bender MIDI converter 13.

The bender MIDI converter 13 converts the linear value into a bender MIDI value by referring to the bender MIDI conversion table 15. At this time, a table that is adequate for a desired style of playing, i.e., a table for a slide or for a legato passage, is prepared as the bender MIDI conversion table 15.

Since the bender MIDI conversion table 15 is designed as a discrete data table, every half a tone, which is appropriate for a desired style of playing, a slide and a legato passage can be simulated.

The bender MIDI value that is obtained by conversion is transmitted via a MIDI output section 8 to an external MIDI device. The MIDI device adds the bender MIDI value to key depression information that is received from the electronic keyboard, i.e., a MIDI output value, and generates a musical tone.

In this manner, to obtain the MIDI output value the bender MIDI value that is designated by the displacement of the pitchbender 4 is added to a musical tone that is being produced in response to the depression of a key, and changes that are each half a tone are provided.

Although in this embodiment a variable resistor is used as the detector 5, the detection means is not limited to this, and a displacement may be measured by a sensor, for example.

Further, although in the embodiment an external MIDI device adds the MIDI output value and the bender MIDI value together, an electronic keyboard, if it incorporates a tone generator, may add them internally.

Figure 5:
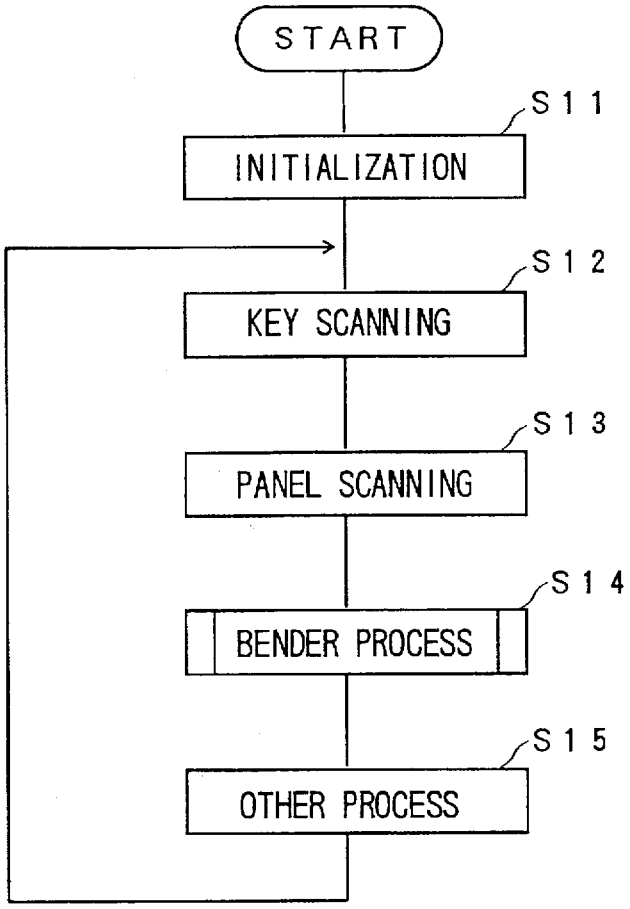
FIG. 5 is a main flowchart for explaining the processing of the present invention.

The processing of the thus structured electronic keyboard according to the embodiment of the present invention will now be explained. FIG. 5 is a flowchart of a main routine for the processing of the electronic keyboard of the present invention.

When the power is switched on, or when a reset switch (not shown) is depressed, first, the initialization process is performed (step S11). During this process, the internal status of the electronic keyboard is set to the initial state to prevent unwanted tones from occurring when the power is switched on, a work area in the RAM 2 is cleared, and data for a register, a flag, a volume, a timbre, etc., are initialized.

Then, a key scan process is performed (step S12). During this process, data that accompany the depression/release of keys at the keyboard 6 are fetched and stored in a predetermined area in the RAM 2. The stored data are transmitted to the MIDI device at a specific time, and are employed for a tone generation process, which will be performed later.

A panel scan process is performed (step S13). During this process, an operation that corresponds to a switch at which an event has occurred in the switch scan process is performed. For example, timbre selection, rhythm selection, and volume control are respectively performed by the manipulation of a timbre select switch, a rhythm select switch, and a volume switch.

The operation for changing the timbre of piano to the timbre of guitar, or for raising or lowering the volume is performed during the panel scan process in consonance with the setup of the panel switches.

Sequentially, a bender process is performed (step S14). During this process, a linear value that is generated by the manipulation of the pitchbender 4 is converted into a bender MIDI value. This process will be described in detail while referring to FIG. 6.

Then, other processes are performed (step S15). More specifically, MIDI information that is acquired by the performance of the key scan process at step S12 and the panel scan process at step S13, and the result that is obtained by the performance of the bender process at step S14 are sent to the MIDI device, tone data are generated by using the MIDI information, and tone generation or recording is performed.

After the other processes at step S15 have been completed, program control returns to step S12 and the process is repeated.

As is described, as the operations at the individual steps of the main routine are repeated, the electronic keyboard can provide a desired style of playing that is in consonance with the manipulation of the keyboard 6 and the console panel 7.

Figure 6:
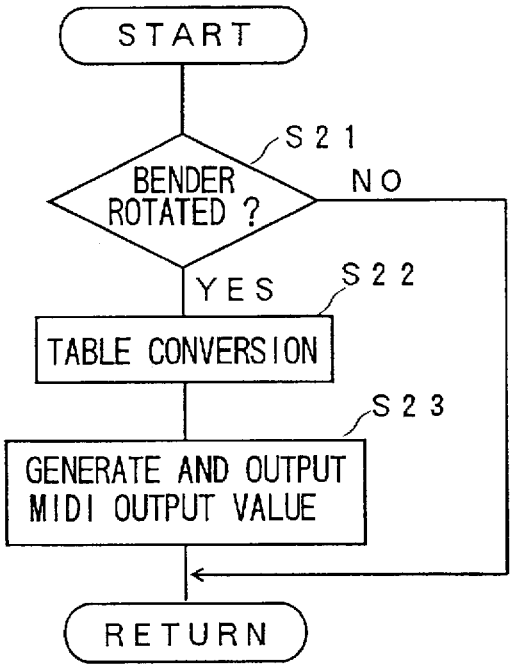
FIG. 6 is a flowchart for explaining a bender process.

The bender process at step S14 in FIG. 5 will be explained while referring to FIG. 6.

During the bender process, first, a check is performed to determine whether or not displacement of the pitchbender 4 has occurred (step S21). For this determination, the CPU 1 examines a flag, in a predetermined area of the RAM 2, that indicates the operational state of the pitchbender 4. The flag will be explained while referring to FIG. 7.

When, at step S21, the flag is OFF, a displacement of the pitchbender 4 has not occurred, and the bender process is therefore not required. The program branches thereafter and program control is returned to the main routine.

If, at step S21, the flag is ON, i.e., when it is ascertained that a displacement of the pitchbender 4 has occurred, a linear value is converted to a bender MIDI output value (step S22).

That is, the bender MIDI converter 13 refers to the bender MIDI conversion table 15, and converts, into the bender MIDI output value, the linear value that is stored in a specific area in the RAM 2.

Sequentially, a MIDI output value is generated and output (step S23). Since, in the tone generator, the discrete bender MIDI value is added to a note that is being produced in response to the depression of a key, a note change of, for example, half a tone is additionally provided during the tone generation.

Figure 7:
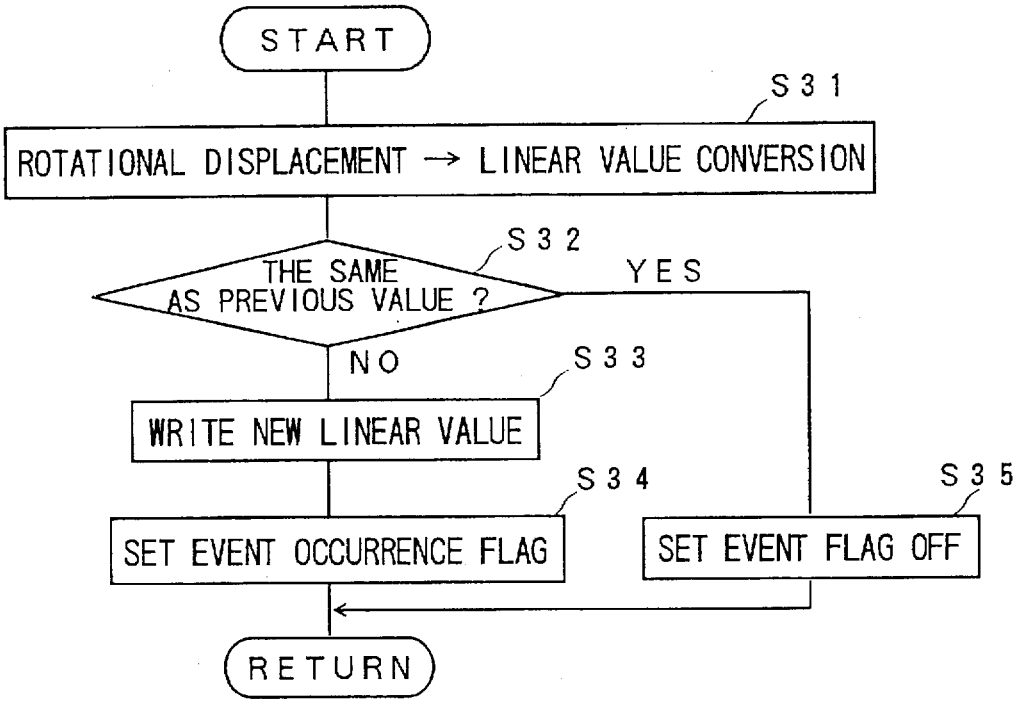
FIG. 7 is a flowchart for explaining a timer interrupt process.

The timer interrupt processing when the pitchbender 4 is displaced will now be explained while referring to FIG. 7.

When a timer (not shown) determines that a predetermined period of time has expired, an interrupt signal is transmitted to the CPU 1 and the timer interrupt processing is performed. During this processing, first, a displacement of the pitchbender 4 is converted into a linear value (step S31).

More specifically, the displacement of the pitchbender 4 is detected as a voltage. The linear converter 12 of the CPU 1 converts the detected voltage into a linear value by referring to the linear conversion table 14.

Then, the currently obtained linear value is compared with a linear value that was previously acquired and is stored in the predetermined area of the RAM 2 (step S32).

When as a result of the comparison it is found that the previous linear value and the current linear value are the same, it is assumed that no displacement of the pitchbender 4 has occurred. An event occurrence flag in a specific area of the RAM 2 is set to off (step S35), and program control is returned to the main routine.

If, as a result of the comparison at step S32, it is found that the previous linear value and the current linear value differ from each other, it is assumed that a displacement of the pitchbender 4 has occurred. The area wherein the previous linear value is stored is overwritten with the currently obtained linear value (step S33).

Next, an event occurrence flag indicating that a displacement of the pitchbender 4 has occurred is set in the specific area of the RAM 2 (step S34). Program control is then returned to the main routine and a given process is performed.

In this manner, the operational state of the pitchbender 4 is constantly updated, and the result of the updating is indicated by a flag. The bender process is therefore performed by examining the flag.

Although, in this embodiment, notes are changed by units of half a tone each, note changes by units of a full tone or by units of an octave is also possible.

As is described above, according to the present invention, with a simple structure wherein the bender MIDI conversion table is changed to a discrete table that is adequate for a slide or for a legato passage, an electronic keyboard can simulate a slide or a legato passage that is similar to that produced by a natural musical instrument.

Various modes of carrying out the invention are contemplated as being within the scope of the following claims that particularly point out and distinctly claim the subject matter regarded as the invention.

What is claimed is:

1. An electronic keyboard having a plurality of keys, each of which generate a musical tone, the electronic keyboard having a sequentially variable operating terminal, the electronic keyboard comprising:

detection means for detecting an operational displacement of said sequentially variable operating terminal, linear conversion means for converting into a linear value said operational displacement of said sequentially variable operating terminal that is detected by said detection means, a linear conversion table that is to be referred to when said linear conversion means converts said operational displacement into said linear value, bender MIDI conversion means for converting into a bender MIDI value said linear value that is obtained by said linear conversion means, the bender MIDI value modifying the musical tone generated by each of the keys; and a bender MIDI conversion table that is to be referred to when said bender MIDI conversion means converts said linear value into said bender MIDI value; and wherein said bender MIDI conversion means refers to said bender MIDI conversion table to convert said operational displacement of said sequentially variable operating terminal into a discrete bender MIDI value.

2. An electronic keyboard according to claim 1, wherein said sequentially variable operating terminal is a pitchbender.

3. An electronic keyboard according to claim 1, wherein said sequentially variable operating terminal is an expression pedal.

4. An electronic keyboard according to claim 1, wherein said sequentially variable operating terminal is one of a wheel, a slider and a volume control.

5. An electronic keyboard according to claim 1, wherein said detection means is a variable resistor.

6. An electronic keyboard which has a sequentially variable operating terminal, comprising:

detection means for detecting an operational displacement of said sequentially variable operating terminal, linear conversion means for converting into a linear value said operational displacement of said sequentially variable operating terminal that is detected by said detection means, a linear conversion table that is to be referred to when said linear conversion means converts said operational displacement into said linear value, bender MIDI conversion means for converting into a bender MIDI value said linear value that is obtained by said linear conversion means, a bender MIDI conversion table that is to be referred to when said bender MIDI conversion means converts said linear value into said bender MIDI value, said bender MIDI conversion table being so set that said bender MIDI value is changed by half a tone relative to said linear value; and wherein said bender MIDI conversion means refers to said bender MIDI conversion table to convert said operational displacement of said sequentially variable operating terminal into a discrete bender MIDI value.

7. An electronic keyboard having a plurality of keys and a sequentially variable operating terminal, the electronic keyboard comprising:

MIDI conversion means for converting the depression of a key on the electronic keyboard into a MIDI output value;

detection means for detecting an operational displacement of the sequentially variable operating terminal;

linear conversion means for converting the operational displacement of the sequential variable operating terminal detected by said detection means into a linear value;

a linear conversion table, the linear conversion table being referred to when the linear conversion means converts the operation displacement into the linear value;

bender MIDI conversion means for converting the linear value obtained by the linear conversion means into a bender MIDI value;

a bender MIDI conversion table, the bender MIDI conversion table being referred to when the bender MIDI conversion means converts the linear value into the bender MIDI value, wherein the bender MIDI conversion means refers to the bender MIDI conversion table to convert the operational displacement of the sequential variable operating terminal to a discrete bender MIDI value; and an MIDI output device, the MIDI output device combining the bender MIDI value and the MIDI output value and generating a musical tone based on the combination of the bender MIDI value and the MIDI output value.

8. The electronic keyboard according to claim 7 wherein the bender MIDI conversion table is so set that the addition of the bender MIDI value to the MIDI output value changes the MIDI output value by half a tone.

9. The electronic keyboard according to claim 7 wherein said sequentially variable operating terminal is a rotational variable resistor.

* * * * *